US008107839B2

(12) United States Patent
Miyaji et al.

(10) Patent No.: US 8,107,839 B2
(45) Date of Patent: Jan. 31, 2012

(54) IMAGE FORMING APPARATUS WITH BIAS APPLYING DEVICE FOR APPLYING A CHARGING BIAS TO A CHARGING ROLLER AND WITH A BIAS CORRECTOR

(75) Inventors: Shinki Miyaji, Osaka (JP); Shigeki Tsukahara, Osaka (JP)

(73) Assignee: Kyocera Mita Corporation (JP)

( * ) Notice: Subject to any disclaimer, the term of this patent is extended or adjusted under 35 U.S.C. 154(b) by 463 days.

(21) Appl. No.: 12/310,141

(22) PCT Filed: Aug. 9, 2007

(86) PCT No.: PCT/JP2007/065600

§ 371 (c)(1),
(2), (4) Date: Feb. 12, 2009

(87) PCT Pub. No.: WO2008/020559

PCT Pub. Date: Feb. 21, 2008

(65) Prior Publication Data

US 2009/0324268 A1 Dec. 31, 2009

(30) Foreign Application Priority Data

Aug. 15, 2006 (JP) ..... 2006-221396

(51) Int. Cl.
*G03G 15/02* (2006.01)

(52) U.S. Cl. ..... 399/50

(58) Field of Classification Search ..... 399/50
See application file for complete search history.

(56) References Cited

U.S. PATENT DOCUMENTS 5,999,760 A 12/1999 Suzuki et al.
6,615,002 B2 9/2003 Saito et al.
7,522,853 B2 * 4/2009 Uchitani ..... 399/50

FOREIGN PATENT DOCUMENTS

| | | | |
|---|---|---|---|
| EP | 1808735 | A1 * | 7/2007 |
| JP | 55029858 | A * | 3/1980 |
| JP | 56099357 | A * | 8/1981 |
| JP | 11-45012 | | 2/1999 |
| JP | 2000338749 | A * | 12/2000 |
| JP | 2002-49225 | | 2/2002 |
| JP | 2002207351 | | 7/2002 |
| JP | 2004-205583 | | 7/2004 |
| JP | 2005-10667 | | 1/2005 |
| JP | 2005-326655 | | 11/2005 |
| JP | 2008009175 | A * | 1/2008 |
| JP | 2008009176 | A * | 1/2008 |

* cited by examiner

*Primary Examiner* — Quana M Grainger
(74) *Attorney, Agent, or Firm* — Gerald E. Hespos; Michael J. Porco

(57) ABSTRACT

A bias corrector conducts a first bias correction calculation by performing first through third calculations. The first calculation compares a stored target charging current value to a first charging current value detected when a first charging bias was applied by a bias applying device. The second calculation is performed repeatedly to calculate a second charging bias based on the comparison result and then to compare the target charging current value to a second charging current value detected by the current detector when the second charging bias was applied by the bias applying device. The third charging bias is calculated based on the comparison result. A second bias correction calculation then is conducted to correct the charging bias obtained as a result of the first bias correction calculation based on photoconductor information detected by a photoconductor information detector.

9 Claims, 9 Drawing Sheets

IMAGE FORMING APPARATUS WITH BIAS APPLYING DEVICE FOR APPLYING A CHARGING BIAS TO A CHARGING ROLLER AND WITH A BIAS CORRECTOR

BACKGROUND OF THE INVENTION

1. Field of the Invention

The present invention relates to an image forming apparatus provided with a function of charging a photoconductor surface using a charging roller and particularly to an image forming apparatus capable of correcting a charging bias.

2. Description of the Related Art

In recent years, a charging roller type having a characteristic of suppressing ozone generation has widely been employed as a charging mechanism of an electrophotographic image forming apparatus. Since the resistance value of this charging roller varies according to the environment and life, there has been proposed a method for determining an output bias based on the detection result of a charging current to apply an optimal bias according to a variation in the resistance of the charging roller.

However, it is very difficult to detect a charging current accurately. This is because a current (charging current) in the charging roller raising a particularly high resistance value varies as the time elapsed immediately after the application of a bias (charging bias), the detection result differs depending on timings at which the current is detected, thereby being incapable a proper bias output in the worst case.

In order to solve such a problem, a method for an image forming operation by repeatedly detecting a current flowing in a charging member during the timing of bias application and starting the image forming operation when a variation between the value of latest detection and the value of previous detection falls below a certain threshold value is disclosed, for example, in JP 2004-205583. If, however, the resistance value of the charging roller drastically increased, this method takes time until the above variation falls below the threshold value, or to stabilize the resistance value, and there is a problem of considerably extending a time (so-called aging time) until the start of the image forming operation time. Further, the method for determining an output value of the bias from the detection result on the charging current has a disadvantage of being unable to output a proper bias if a current-to-voltage characteristic (I-V characteristic) of the photoconductor changes with temperature.

SUMMARY OF THE INVENTION

An object of the present invention is to provide an image forming apparatus capable of outputting a proper charging bias without extending a time until the start of an image forming apparatus even if the resistance value of a charging roller varies and outputting a proper charging bias even if a current-to-voltage characteristic of a photoconductor changes.

In one preferable embodiment, an image forming apparatus of the present invention for charging a surface of a photoconductor to a specified potential using a charging roller provided with: a bias applying device for applying a charging bias to the charging roller; a current detector for detecting a charging current when the charging bias is applied; a storage for storing a target charging current value which is a charging current value as a target when the surface of the photoconductor is charged to a necessary surface potential; a bias corrector for correcting the charging bias; and a photoconductor information detector for detecting photoconductor information concerning the temperature of the photoconductor, wherein the bias corrector conducts a first bias correction calculation by performing a first calculation in which a first charging current value detected by the current detector when the first charging bias as an initially set value was applied by the bias applying device is compared with the target charging current value stored in the storage, and by performing, repeatedly a specified number of times, a second calculation in which a second charging bias based on the comparison result and a second charging current value detected by the current detector when the second charging bias was applied by the bias applying device is compared with the target charging current value in order to calculate a third charging bias based on the comparison result, and conducts a second bias correction calculation to correct the charging bias obtained as a result of the first bias correction calculation based on the photoconductor information detected by the photoconductor information detector.

According to this, the first bias correction calculation is conducted repeatedly to compare the charging current value when a certain bias is applied with the target charging current value and to calculate the charging bias based on the comparison result (at this time, however, the total number of calculations in the first bias correction calculation is determined, for example, to two beforehand), and the second bias correction calculation is conducted to correct the charging bias obtained as a result of the first bias correction calculation based on the photoconductor information concerning the temperature of the photoconductor. Thus, a proper charging bias can be outputted without extending a time until the start of an image forming operation even if the resistance value of the charging roller varies and a proper charging bias can be outputted even if a current-to-voltage characteristic of the photoconductor changes.

DETAILED DESCRIPTION OF THE PREFERRED EMBODIMENTS

Figure 1:
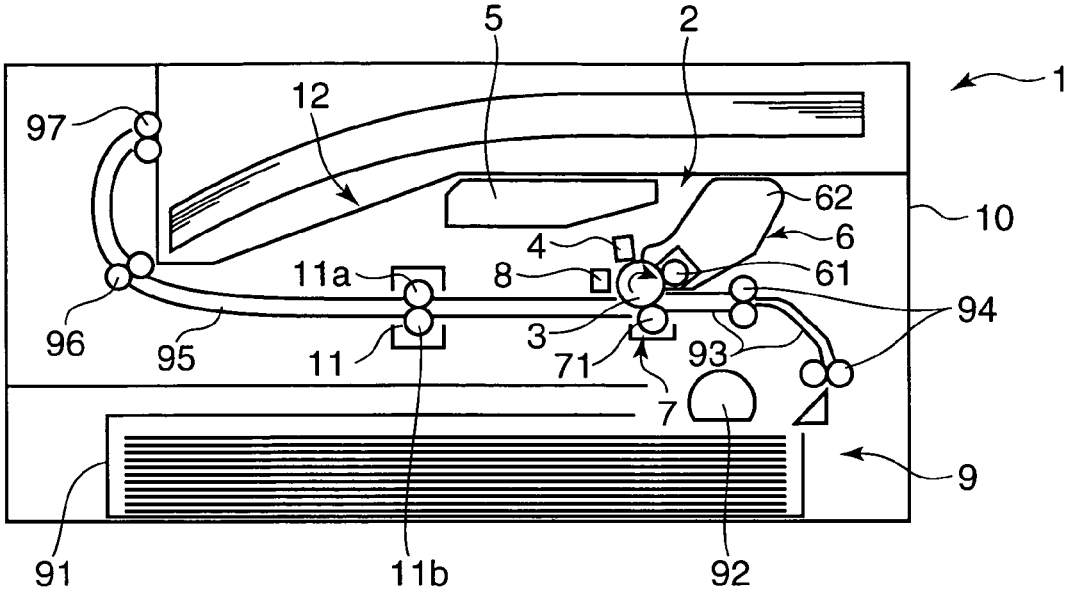
FIG. 1 is a section view schematically showing the internal construction of an image forming apparatus according to one embodiment of the invention.

FIG. 1 is a section view schematically showing the internal construction of an image forming apparatus according to one embodiment of the present invention. The image forming apparatus according to the present invention is a copier, a printer, a facsimile machine or the like for developing an electrostatic latent image using toner by an electrophotographic method. In this embodiment, a printer 1 is described as an example of the image forming apparatus. In the printer 1, an image forming unit 2 is provided in a printer main body 10. As shown in FIG. 1, the image forming unit 2 is for forming an image on a sheet and includes a photoconductive drum 3 and a charger 4, an exposing device 5, a developing device 6, a transfer device 7, and a cleaning device 8 arranged around the photoconductive drum 3.

Figure 2:
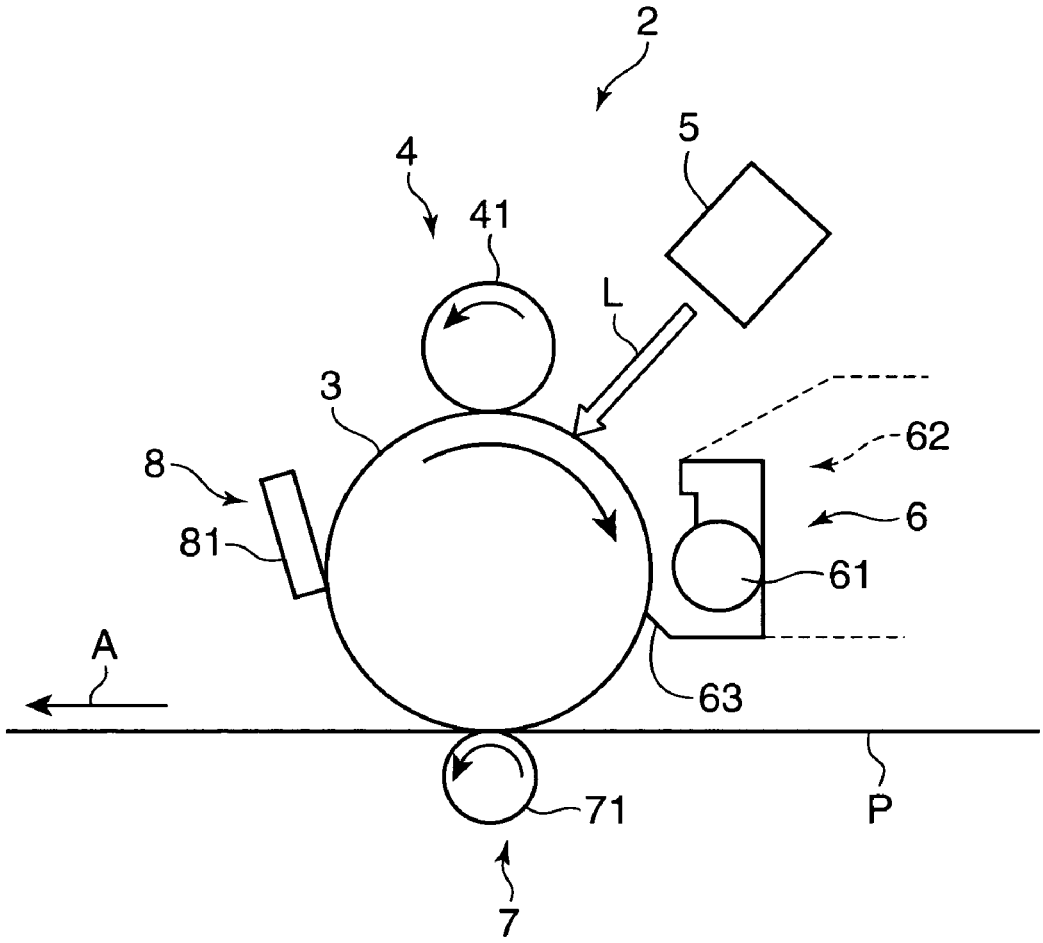
FIG. 2 is a partial enlarged view schematically showing an image forming unit of a printer shown in FIG. 1.

FIG. 2 is a partial enlarged view schematically showing the image forming unit 2. The photoconductive drum 3 is an image bearing member supported rotatably in a direction of arrow in FIG. 1. Here, a photoconductive drum (a-Si drum) made of amorphous silicon (a-Si) is employed. This a-Si drum is such that an amorphous silicon film is formed on the outer surface of a specified drum-like body (cylindrical body) by deposition or the like. This amorphous silicon film has a property of very high film surface hardness. The photoconductive drum 3 employed here has a drum diameter of about 30 mm and is rotated at a speed (liner velocity; rotational circumferential speed) of about 310 mm/sec.

The charger 4 is a part which uniformly charges the surface (drum surface) of the photoconductive drum 3 to a specified potential of, e.g. about +250 V. The charger 4 includes a charging roller 41 arranged to face the photoconductive drum 3, and the charging is performed by this charging roller 41 in a pressed state against the photoconductive drum 3. The charging roller 41 is, for example, such that an elastic layer made of ion conductive material (semiconductive material) such as epichlorohydrin rubber is so formed on a specified cored bar as to have a roller diameter of, e.g. about 12 mm. Surface roughness Rz of this epichlorohydrin rubber is, for example, about 10 μm.

Since the ion conductive material is normally used for the charging roller 41 as described above, the resistance value thereof varies according to environment (temperature and humidity) and life (passage of time). Since an I-V characteristic of the photoconductor also varies with temperature in the photoconductive drum 3 charged by the charging roller 41, the drum surface cannot be charged to the necessary surface potential with an initial charging bias left as it is. Accordingly, in this embodiment, the charging bias (Vdc) is so corrected as to obtain the necessary surface potential. This charging bias correction is described in detail later.

The exposing device 5 is a so-called laser scanner unit which exposes the photoconductive drum 3 with a laser beam. The exposing device 5 forms an electrostatic latent image on the drum surface by irradiating the drum with a laser beam L outputted from a laser diode based on image data transmitted from an image data storage 40 to be described later or the like. The exposing device 5 shown in FIG. 2 shows the exposing device 5 shown in FIG. 1 in a simpler manner.

The developing device 6 develops an image by attaching toner to the electrostatic latent image formed on the drum surface. The developing device 6 is constituted by including a developing roller 61 arranged to face the photoconductive drum 3 in a non-contact manner, a toner container 62 containing the toner and a restricting blade 63 (leveling plate) and the like. The restricting plate 63 restricts the amount of toner supplied from the toner container 62 to the developing roller 61 to a proper amount. Specifically, the restricting plate 63 levels the toner attached in a so-called HODACHI state (state of a magnetic brush in uneven manner) to the surface of a sleeve (not shown) of the developing roller 61, i.e. restricts a layer thickness to adjust the attached amount to a fixed amount. By this adjustment of the attached amount, a toner thin layer having substantially the constant thickness is formed on the sleeve.

The transfer device 7 is for transferring a toner image to a sheet. Specifically, the transfer device 7 includes a transfer roller 71 arranged to face the photoconductive drum 3 and transfers the toner image developed on the drum surface to a sheet P (transfer material) conveyed in a direction of arrow A with the sheet P pressed against the photoconductive drum 3 by the transfer roller 71.

The cleaning device 8 includes a cleaning blade 81 and the like for cleaning the toner (transfer residual toner) residual on the drum surface after the transfer by the transfer device 7 is completed. The cleaning blade 81 has, for example, an end thereof pressed into contact with the drum surface, whereby the residual toner on the drum surface is mechanically removed. A charge neutralizer (erase light source) (not shown) for removing electric charges from the photoconductor surface by a neutralization beam such as an LED beam, i.e. removing residual potential (electric charges) is disposed between the cleaning device 8 and the charger 4.

The printer 1 is also provided with a sheet feeding unit 9 for feeding a sheet toward the image forming unit 2 (photoconductive drum 3) and a fixing unit 11 for fixing the toner image transferred to the sheet. The sheet feeding unit 9 includes a sheet cassette 91 for storing sheets of the respective sizes, a pickup roller 92 for picking up a stored sheet, a conveyance path 93 as a path in which the sheet is conveyed, conveyor rollers 94 for conveying the sheet in the conveyance path 93 and the like, and conveys the sheets fed one by one from the sheet cassette 91 to a nip between the transfer roller 71 and the photoconductive drum 3. The sheet feeding unit 9 conveys the sheet (above sheet P) having the toner image transferred thereto to the fixing unit 11 via a conveyance path 95 and further conveys the sheet finished with a fixing process in the fixing unit 11 to a sheet discharge tray 12 provided at the top of the printer main body 10 by conveyor rollers 96 and discharge rollers 97.

The fixing unit 11 includes a heat roller 11*a* and a pressure roller 11*b*, melts the toner on the sheet by heat from the heat roller 11*a* and applies pressure by the pressure roller 11*b* to fix the toner image to the sheet.

Figure 3:
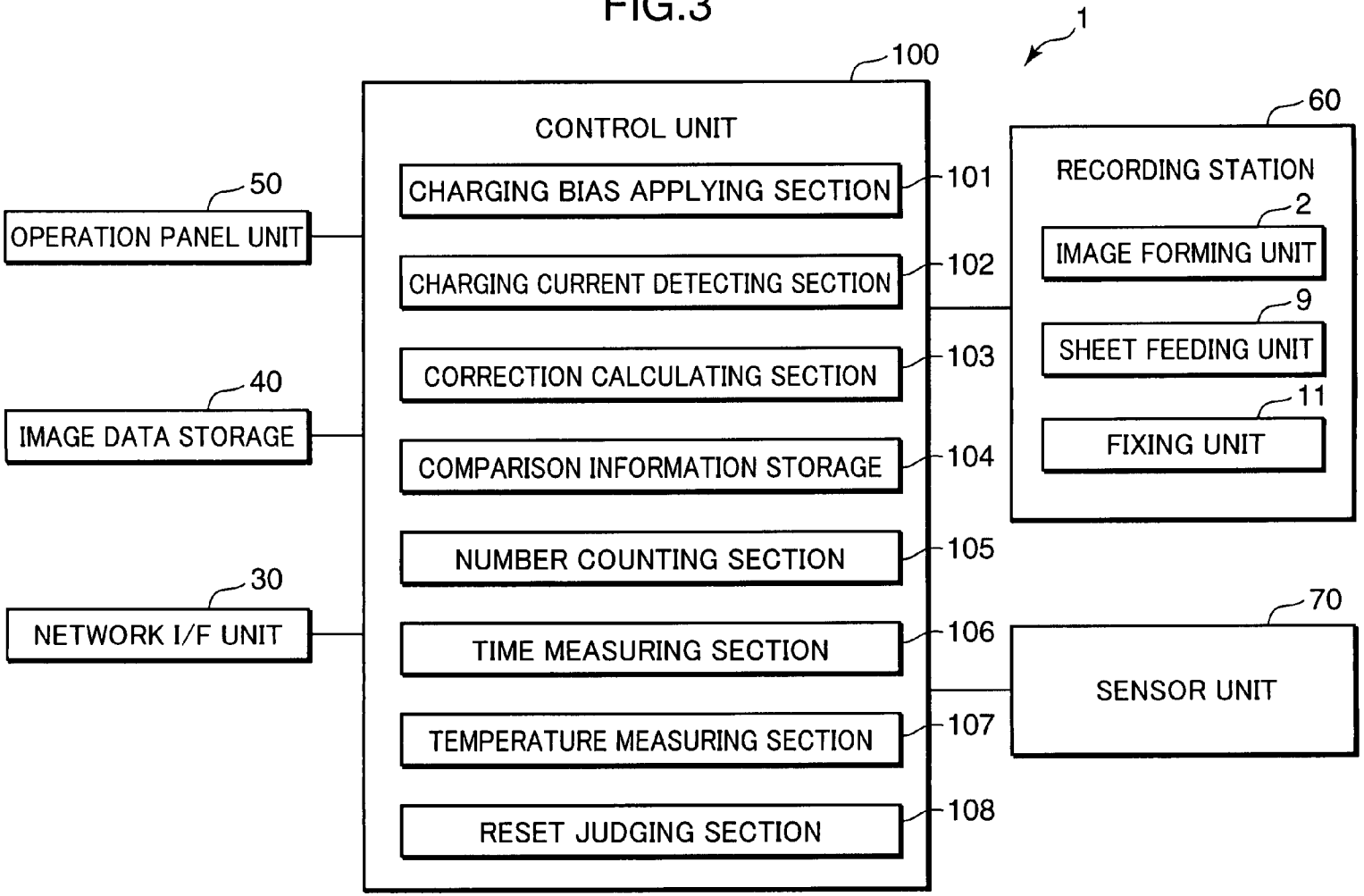
FIG. 3 is a block diagram showing an exemplary electrical construction of the printer shown in FIG. 1.

FIG. 3 is a block diagram showing an exemplary electrical construction of the printer 1. As shown in FIG. 3, the printer 1 is provided with a network I/F (interface) unit 30, the image data storage 40, an operation panel unit 50, a recording station 60, a sensor unit 70, a control unit 100 and the like. The network I/F unit 30 controls transmission and reception of various data to and from an information processing apparatus (external apparatus) such as a PC connected via a network such as a LAN. The image data storage 40 is for temporarily storing image data transmitted from the PC or the like via the network I/F unit 30. The operation panel unit 50 is provided at a front part or the like of the printer 1, functions as input keys used by a user to input various pieces of instruction information (commands) or displays specified information. The recording station 60 includes the image forming unit 2, the sheet feeding unit 9 and the fixing unit 11 and records (prints)

image information on a sheet based on image data, for example, stored in the image data storage 40.

The sensor unit 70 is for detecting the temperatures of the respective parts of the printer 1. Specifically, temperature inside the printer 1 and temperature outside the printer 1 (outside the apparatus) are detected. The temperature inside the printer 1 is detected, for example, by a temperature sensor disposed near (in the vicinity of) the photoconductive drum 3. The temperature outside the printer 1 is detected, for example, using a temperature sensor (ambient temperature sensor) capable of measuring an outside air temperature and disposed, for example, on the outer wall surface of the printer main body 10. Particularly, for the temperature inside the printer 1, it is sufficient to be able to judge (estimate) the temperature of the photoconductor of the photoconductive drum 3. For example, temperature obtained by converting temperature detected by a thermistor (fixing thermistor) as a temperature sensor disposed in the fixing unit 11 by a specified relational expression may be used. Of course, the temperature of the photoconductor (photoconductive drum 3) may be directly detected using, for example, a temperature sensor. In this case, the sensor unit 70 functions to directly measure the temperature of the photoconductor.

The control unit 100 includes a ROM (Read Only Memory) for storing a control program and the like of the printer 1, a RAM (Random Access Memory) for temporarily saving data, a microcomputer for reading the above control program or the like from the ROM and implementing it and controls the entire apparatus in accordance with specified instruction information inputted in the operation panel unit 500 or the like and detection signals from various sensors (including the above sensor unit 70) disposed at positions of the printer 1. The control unit 100 is provided with a charging bias applying section 101, a charging current detecting section 102, a correction calculating section 103, a comparison information storage 104, a number counting section 105, a time measuring section 106, a temperature measuring section 107 and a reset judging section 108.

The charging bias applying section 101 is a section which applies the charging bias Vdc to the charging roller 41 (performs a charging bias application control). The symbol Vdc represents direct-current (DC) components of the charging voltage. This charging bias Vdc may be comprised only of DC components or may be comprised of DC components and alternating-current (AC) components superimposed on the DC components. The charging potential of the drum surface is, however, determined by the bias (DC bias) Vdc of direct-current components. In this embodiment, the charging bias in which the alternating-current components are superimposed on the direct-current components is used.

The charging current detecting section 102 is a section which detects a charging current (DC current) Idc when the charging bias Vdc is applied to the charging roller 41 by the charging bias applying section 101. This charging current Idc may be detected from the charging roller 41 side, i.e. detection of a charging current flowing, for example, in the charging roller 41 or may be detected at the photoconductive drum 3 side, i.e. detection of a charging current flowing, for example, from the charging roller 41 to the drum surface. The reason why the charging current is detected in this way instead of directly detecting the surface potential of the photoconductive drum 3 is to avoid problems that a device for measuring a surface potential is generally costly and requires an extra installation space to enlarge the apparatus.

The correction calculating section 103 is a section which performs a correction calculation (bias correcting process) for correcting the charging bias Vdc. Specifically, the correction calculating section 103 compares the charging current Idc detected by the charging current detecting section 102 with a target current Idc(T) to be described later when a charging bias initially set is applied to the charging roller 41 by the charging bias applying section 101, and calculates a new charging bias obtained by adding (ON) a bias correction value, which is the product of a difference between these current values Idc and Idc(T) and a correction coefficient k (this correction coefficient "k" is described later), to the charging bias Vdc initially set, i.e. a corrected charging bias obtained by correcting the charging bias. The correction calculating section 103 outputs the information of this corrected charging bias to the charging bias applying section 101. Subsequently, the charging current Idc detected by the charging current detecting section 102 is detected when this corrected charging bias is applied to the charging roller 41 by the charging bias applying section 101, and similarly calculates a new charging bias obtained by adding a bias correction value, which is the product of the difference between these current values Idc and Idc(T) and the correction coefficient k, to the corrected charging bias (this information of the corrected charging bias is also outputted to the charging bias applying section 101). In this way, the correction calculating section 103 repeats a calculation routine of calculating a correction value (bias correction value) from the charging current value (Idc) and the comparison value (Idc(T)), setting a new charging bias by correcting the charging bias using this correction value and giving the charging bias to the charging bias applying section 101 a necessary number of times (this calculation is called a first bias correction calculation).

Such a repeat calculation can be said to be a calculation of obtaining an $(n+1)^{th}$ charging bias by adding an $n^{th}$ bias correction value calculated by the following equation (1) to an $n^{th}$ charging bias.

$$(Idc(T)-Idc(n))*k \quad (1)$$

where "*" denotes multiplication (same below), "n" a repeat count (n is a natural number) and Idc(n) an $n^{th}$ charging current. The symbol "k" is the above correction coefficient.

Although this calculation is carried out only twice (n=up to 2) as shown in a flow chart to be described later in this embodiment, it may be repeated three times or more (the larger the repeat count, the higher the correction accuracy). However, if the repeat count is too large, it takes time until an image forming operation is started. Thus, it is preferable to set a specified proper repeat count, e.g. about three or four times. This repeat count may be set as a predetermined value (fixed value) or may be a value determined to terminate the repeat calculation, for example, if a rate of change by the charging bias correction (e.g. difference in the charging bias before and after correction) reaches a specified level (in this case as well, a specified level is to terminate the repeat calculation after several times so that the repeat count is not excessively large). The information of the initially set charging bias is stored, for example, in the correction calculating section 103 or the charging bias applying section 101. The information of the above correction coefficient k is stored, for example, in the correction calculating section 103. Although the bias correction value is "added" to the charging bias to obtain a new charging bias in the above, this "addition" is assumed to also mean "subtraction" (i.e. adds a negative value). Since the charging bias actually decreases, the bias correction value is added to compensate for this decrease. The bias correction value may be calculated in accordance with an equation other than the equation (1) and the calculation method for correcting the charging bias using the bias correction value may be other than the above addition and subtraction (e.g. multiplication and division).

The correction calculating section 103 further performs a calculation (this is called a second bias correction calculation) to correct the charging bias Vdc obtained as a result of the above first bias correction calculation based on a cumulative print number (total print number) information after the printer 1 is turned on. Specifically, the correction calculating section 103 determines a bias correction value corresponding to the cumulative print number. For example, the correction calculating section 103 sets, for example, 10 (V) as the bias correction value if the cumulative print number is 500 or larger and sets, for example, 20 (V) as the bias correction value if the cumulative print number is 1000 or larger, and adds this bias correction value to the charging bias Vdc. This is because the temperature of the photoconductor increases as printing is repeated, i.e. the temperature of the photoconductor increases as the cumulative print number increases (as shown, for example, in FIG. 4, as the cumulative print number increases to 500, 1000, . . . a photoconductor temperature (° C.) increases), and an I-V characteristic changes (as shown, for example, in FIG. 5, the charging current value (μA) increases with the charging voltage assumed to be constant at 250 V as the photoconductor temperature (° C.) increases). Thus, the cumulative print number is used as an indicator, so to speak, for estimating the temperature of the photoconductor, and the bias correction value (e.g. the above voltage value of 10V or 20V) set according to the cumulative print number is added to the charging bias. From this, the second bias correction calculation can be said to be a calculation for correcting the charging bias according to the temperature of the photoconductor.

Figure 4:
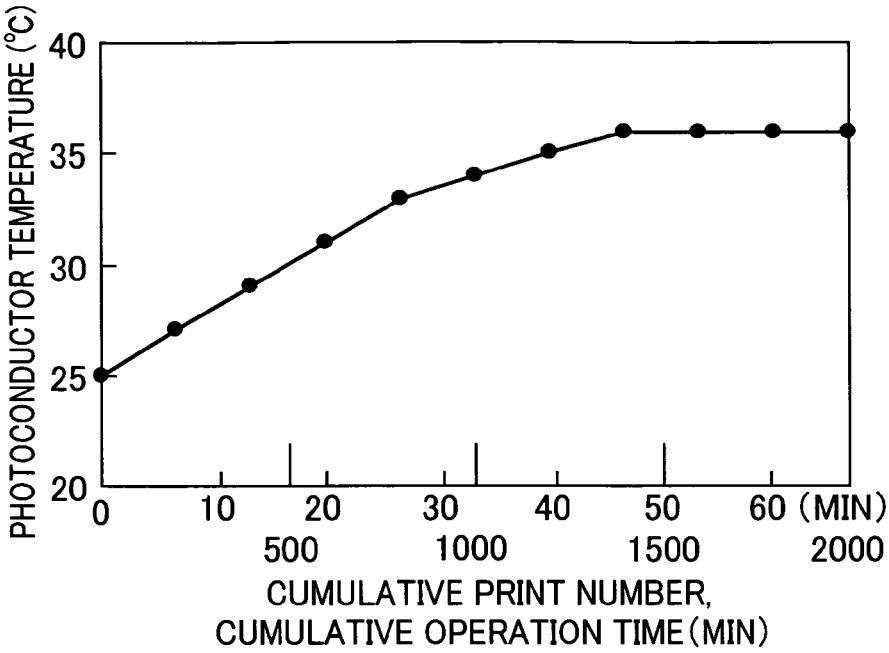
FIG. 4 is a graph showing a relationship of a cumulative print number, a cumulative operation time and a photoconductor temperature in the printer shown in FIG. 1.
Figure 5:
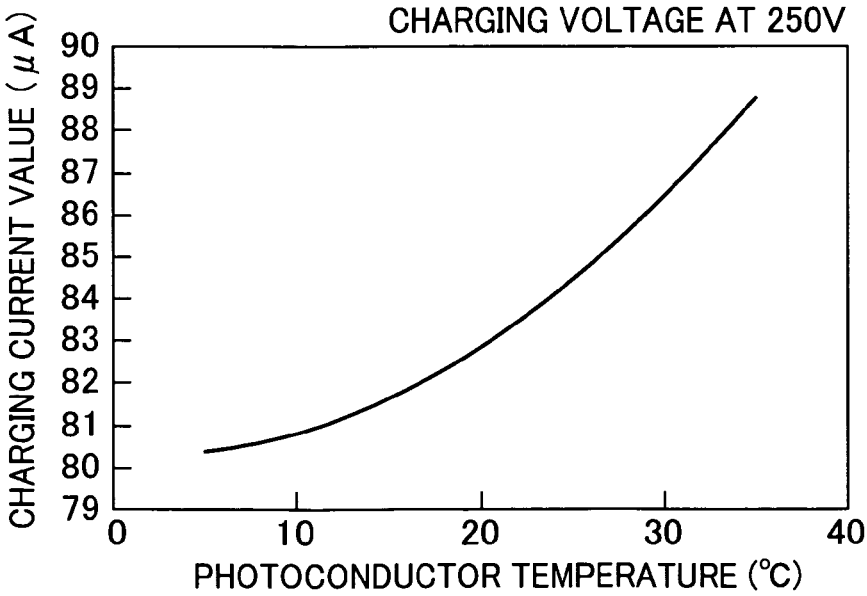
FIG. 5 is a graph showing a relationship of a photoconductor temperature and a charging current value in the printer of FIG. 1.

As the indicator for estimating the temperature of the photoconductor, it may be used not only the cumulative print number, but also, for example, a cumulative operation time (driving time) of the printer 1 after the printer 1 is turned on. That is, since the cumulative operating time and the temperature of the photoconductor are in such a relationship that the photoconductor temperature (° C.) increases as the cumulative operating time (min) increases, for example, as shown in FIG. 4 (shown together with a relationship of the cumulative print number and the photoconductor temperature), this cumulative operating time may be used as the indicator for estimating the temperature of the photoconductor and a bias correction value (e.g. the above voltage value of 10V or 20V) set according to the cumulative operating time may be added to the charging bias. In short, any information may be used provided that the information is in a certain correspondence relationship with the temperature of the photoconductor (photoconductor information). Of course, a temperature sensor may be disposed near the photoconductive drum 3 and the temperature detected thereby may be used as the photoconductor information (photoconductor temperature). Alternatively, a temperature sensor for detecting the temperature of the photoconductive drum 3 (photoconductor) may be disposed and the temperature obtained by measuring the photoconductor may be directly used as the photoconductor information (photoconductor temperature). The correction calculating section 103 obtains the cumulative print number, the cumulative operating time or the photoconductor temperature information from respectively the number counting section 105, the time measuring section 106 or the temperature measuring section 107 to be described later.

In accordance with a judgment result by the reset judging section 108 to be described later, the correction calculating section 103 also resets the charging bias (corrected charging bias) corrected by the above first and second bias correction calculations to a specified initial value, e.g. a value before the second bias correction calculation (charging bias value after the first bias correction calculation). This may be reset to a value before the first and second bias correction calculations, i.e. the above initially set charging bias value.

The comparison information storage 104 is a section which stores information (comparison value) to be compared with the charging currents successively obtained upon the application of charging biases in the respective repeat calculations in the above first bias correction calculation. The comparison information is the memorized information of the target current Idc(T) as a target value, so to speak, when a normal surface potential (about +250 V) is obtained, e.g. by pre-measurement is present on the drum surface, i.e. when the drum surface is charged to a necessary surface potential. Strictly speaking, the I-V characteristic of the photoconductor differs from one photoconductor to another, and therefore, it is desirable to store Idc(T) measured for the photoconductive drum of each printer at the time of manufacturing. Actually, not only the information of the target current Idc(T), but also the information of a voltage value for charging to the normal surface potential (about +250 V) is stored together with this target current Idc(T).

The number counting section 105 is a section which counts the number of prints made. The number counting section 105 may count the print number by counting every time one printing operation is completed, e.g. every time a transfer operation in the transfer device 7 is completed. Alternatively, an optical sensor such as a photocoupler may be disposed in the conveyance path 93 or 95, and the print number may be counted by detecting the passage of a sheet at the position of this optical sensor. Of course, the passage of the sheet may be detected by a mechanical switch. In this construction, the number counting section 105 counts the total value (cumulative print number) of prints made after the printer 1 is turned on. For example, if a certain print job made after power is turned on includes 100 prints and the next job includes 200 prints, the number counting section 105 counts the cumulative print number to be 300. This count (number) information is stored, for example, in the number counting section 105. The number counting section 105 resets the cumulative print number to an initial value, e.g. zero according to the judgment result by the reset judging section 108 to be described later.

The time measuring section 106 is a section which measures the cumulative operating time (driving time) of the printer 1 after the printer 1 is turned on, using an internal clock or the like. When power is turned off, this cumulative operating time is saved (stored) as it is in the time measuring section 106 without being erased (reset). The time measuring section 106 measures an elapsed time from the end of a printing operation in the last print job (last printing operation). The measurement of this elapsed time is continued using the above internal clock, for example, even after power is turned off. The time measuring section 106 resets the cumulative operating time to an initial value, e.g. zero according to the judgment result by the reset judging section 108 to be described later.

The temperature measuring section 107 is a section which measures the temperature inside the printer 1 (internal temperature) and the temperature outside the printer 1 (external temperature) based on detection information from the sensor unit 70.

The reset judging section 108 is a section which judges (reset judgment) whether or not to satisfy a condition (first condition) that the temperature inside the printer 1−the temperature outside the printer≦specified temperature, i.e.

whether or not the temperature near the photoconductive drum 3 has dropped until a difference between the temperature near (in the vicinity of) the photoconductive drum 3 in the printer 1, for example, and the temperature outside the printer 1 falls to or below a certain temperature (e.g. 3° C. to be described later) when power is turned on, or whether or not to satisfy a condition (second condition) that the elapsed time from the end of the printing operation in the last print job≧specified time, i.e. whether or not a specified time (e.g. 15 minutes to be described later) or longer has elapsed, for example, from the end of the last print job when power is turned on.

The temperature inside the printer 1 (apparatus internal temperature) gradually decreases after power is turned off and eventually approaches the temperature outside the printer (apparatus external temperature). Concerning this, a relationship between the temperature difference (drum temperature−apparatus external temperature) between the temperature (drum temperature) of the photoconductive drum 3 (photoconductor) and the apparatus external temperature, and the elapsed time (standing time) after power is turned off is shown, for example, by a graph (temperature variation characteristic 301) indicated by reference numeral 301 in FIG. 6. If the temperature of the photoconductive drum 3 when power is on is assumed to be, for example, 32° C. (saturation temperature of the photoconductive drum is, for example, +10° C. plus room temperature of 20° C.), i.e. if the temperature difference from the room temperature at 20° C. is about 12° C., the temperature difference, which was 12° C. when power was turned off, decreases with time and, for example, falls to about 3° C. after 15 minutes as shown by the temperature variation characteristic 301. In this embodiment, the specified temperature in the above first condition is set to "3° C." and the specified time in the above second condition is set to "15 minutes". Not the temperature near the photoconductive drum 3, but the temperature of the photoconductive drum 3 (photoconductor) may be used as the temperature of the photoconductive drum 3 (photoconductor) inside the printer 1.

Figure 6:
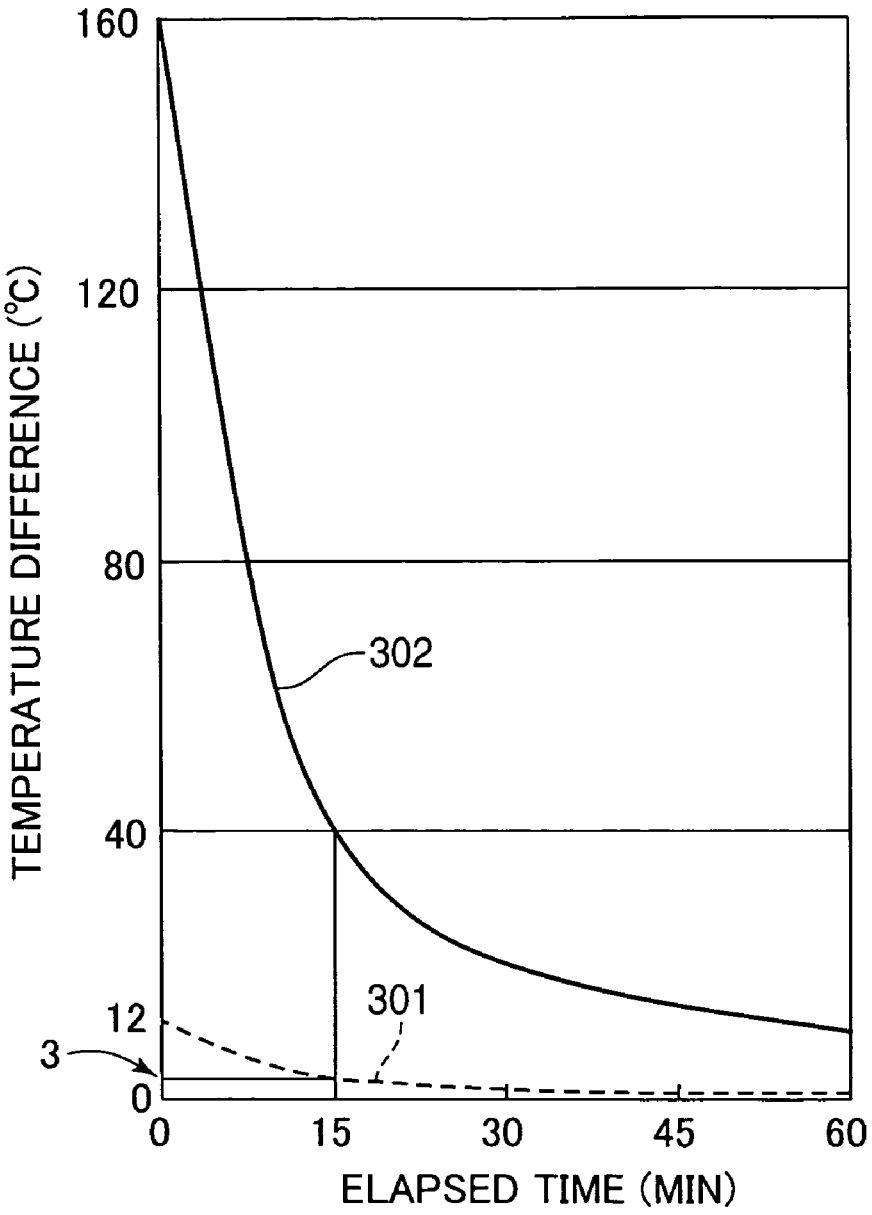
FIG. 6 is a graph showing temperature transition with time of a temperature difference between a photoconductive drum (photoconductor) temperature and a temperature outside the apparatus and a temperature difference between a fixing thermistor temperature and the temperature outside the apparatus in the printer shown in FIG. 1.

Meanwhile, another example of the first condition may be the use of temperature detected by the fixing thermistor disposed in the fixing unit (fixing thermistor temperature) as the temperature inside the printer 1. Specifically, a relationship between the temperature difference (fixing thermistor temperature-apparatus external temperature) between the fixing thermistor temperature and the apparatus external temperature, and the elapsed time (standing time) after power is turned off is shown as a temperature variation characteristic 302 in FIG. 6. Since the temperature variation characteristics 302 and 301 have a relationship as shown in FIG. 6, the above drum temperature may be estimated from the fixing thermistor temperature. In this case, 40° C. in the temperature variation characteristic 302 at the same elapsed time (15 minutes) as 3° C. may be used instead of 3° C. as the specified temperature in the above first condition. In other words, a conversion equation of drum temperature−apparatus external temperature=0.075×specified temperature may be used, and 40° C. obtained from the fixing thermistor temperature−apparatus external temperature may be used as the specified temperature in this equation.

If it is judged by the reset judging section 108 that the first or second condition is satisfied, rest operations of the cumulative print number and the corrected charging bias in the number counting section 105 and the correction calculating section 103, or the cumulative operating time and the corrected charging bias in the time measuring section 106 and the correction calculating section 103 are conducted.

The reset judgment is made by providing the reset judging section 108 in this way in order to prevent the charging bias from being reset despite no drop in the temperature of the photoconductor when power is turned off and on within a very short period of time, for example, due to a certain machine trouble (including an operation caused by the user). Meanwhile, it is intended to prevent the use of the corrected bias value although the temperature of the photoconductor has decreased when power is turned on. In the actual apparatus (printer 1), the temperature measuring section 107 may not be provided if no judgment on the above first condition is made and the photoconductor temperature is not handled as the photoconductor information. The time measuring section 106 may not be provided if no judgment on the above second condition is made and the cumulative operating time is not handled. Further, the number counting section 105 may be not provided if the cumulative print number is not handled.

Here, the correction coefficient "k" in the first bias correction calculation by the above correction calculating section 103 is described. The value of this correction coefficient "k" is, for example, a numerical value derived by the following equation (1.1):

$$\Delta V=(\Delta Q*d)/(\in*\in_0*\Delta S) \tag{1.1}$$

where "/" denotes division (same below).

Further, ΔV: a variation of the surface potential; ΔQ: a variation of electric charges (i.e. ΔQ denotes a current amount), d: photoconductor thickness (layer thickness of the photoconductor), s: charged area, ∈: dielectric constant of the photoconductor, and $\in_0$: dielectric constant of vacuum.

The above equation (1.1) is derived from an equation (1.3) obtained by converting an equation (1.2).

$$Q=C*V=\in*\in_0*(S/d)*V \tag{1.2}$$

$$V=(Q*d)/(\in*\in_0*S) \tag{1.3}$$

Here, taking a printer with a certain performance (e.g. printer capable of producing 45 copies per minute) as an example, if, for example, ΔQ=1, d=16 μm, S=(220*307) $mm^2$ and the respective dielectric constants are substituted into the above equation (1.1), ΔV≈2. The numeral 220 in S indicates a charge effective width 220 mm of the charging roller, and the numeral 307 indicates a liner velocity of 307 mm/sec (moving distance of the photoconductor per second) of this printer capable of producing 45 copies per minute.

The result of such substitution indicates that the surface potential changes by about 2 V for a current of 1 μA. Accordingly, in the case of considering (Idc(T)−Idc(n))*k of the above equation (1), if the detected charging current (Idc(n)) is, for example, 75 μA and is 5 μA lower than the target current Idc(T) of, e.g. 80 μA (Idc(T)−Idc(n)=5 μA) in the printer capable of producing 45 copies per minute, the surface potential of the photoconductor decreases by 5*2=10 V. Thus, this decrease of 10 V needs to be corrected.

In the case of another printer capable of producing 30 copies per minute, the liner velocity is 178 mm/sec. If this is similarly substituted into the above equation (1.1), ΔV≈4 and the surface potential of the photoconductor decreases by 5*4=20 V. Thus, this decrease of 20 V needs to be corrected. In short, the correction coefficient k is ΔV (k=ΔV) shown in the above equation (1.1) and the unit thereof is (V/μA) in this embodiment. This correction coefficient k is a value which varies according to the moving speed (linear velocity) of the photoconductor.

Figure 7:
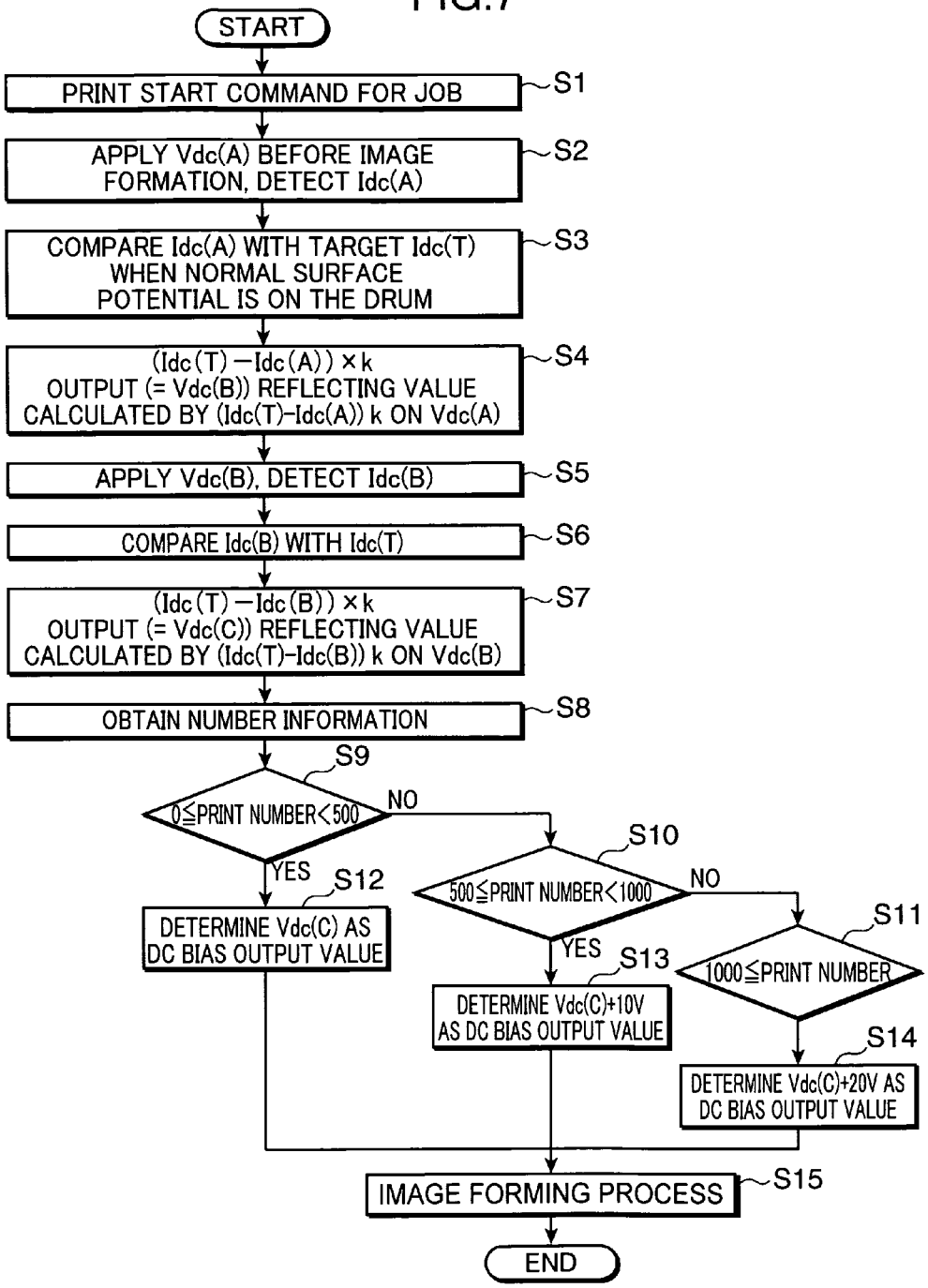
FIG. 7 is a flow chart showing an exemplary operation of correcting a charging bias according to the embodiment.

FIG. 7 is a flow chart showing an exemplary operation of correcting the charging bias according to this embodiment. First, a print start command is given for a certain print job, for example, by inputting an instruction from a user by means of the operation panel unit 50 or the like (Step S1). The charging bias applying section 101 applies the charging bias Vdc(A) to the charging roller 41 before performing an actual image forming operation for this print job and the charging current detecting section 102 detects the charging current Idc(A) during the application of this charging bias Vdc(A) (Step S2). This charging bias Vdc(A) is a charging bias as an initially set value.

Subsequently, the correction calculating section 103 compares the charging current Idc(A) detected in Step S102 with the target current Idc(T) prestored in the comparison information storage 104, specifically calculates a difference between these current values by subtracting Idc(A) from Idc (T) (Step S3). The correction calculating section 103 calculates a bias correction value by an equation of (Idc(T)−Idc (A))*k (corresponding to a case where n=1 in the above equation (1)), calculates a charging bias Vdc(B) by adding (reflecting) this calculated bias correction value to (on) the above charging bias Vdc(A), and outputs the information of this charging bias Vdc(B) to the charging bias applying section 101 (Step S4). The operations in Steps S2 to S4 correspond to the first repeat calculation.

Subsequently, similarly, the charging bias applying section 101 applies the charging bias Vdc(B) to the charging roller 41 and detects a charging current Idc(B) during the application of this charging bias Vdc(B) (Step S5). The correction calculating section 103 compares the detected charging current Idc(B) with the target current Idc(T) (Step S6), calculates a charging bias Vdc(C) by adding a bias correction value calculated by an equation of (Idc(T)−Idc(B))*k (corresponding to a case where n=2 in the above equation (1)) to the charging bias Vdc(B) and outputs the charging bias Vdc(C) to the charging bias applying section 101 (Step S7). The operations in Steps S5 to S7 correspond to the second repeat calculation. In this embodiment, the repeat calculation is completed after the second one, whereby the charging bias Vdc(C) as a result of the first bias correction calculation is obtained.

Subsequently, the correction calculating section 103 obtains the information of the cumulative print number after the printer 1 was turned on from the number counting section 105 (Step S8). If the cumulative print number is 0 or no more than 500 (YES in Step S9), the correction calculating section 103 determines to directly use the charging bias Vdc(C) calculated in the first bias correction calculation as the charging bias to be applied to the charging roller 41, assuming, for example, no influence by a temperature increase of the photoconductor (Step S12). If the cumulative print number is equal to or larger than 500 and below 1000 (NO in Step S9, YES in Step S10), the correction calculating section 103 calculates the charging bias Vdc(C)+10V by adding (reflecting) the bias correction value of 10 V to (on) the charging bias Vdc(C) calculated in the first bias correction calculation as the charging bias to be applied to the charging roller 41 (Step S13). If the cumulative print number is equal to or larger than 1000 (NO in Step S10, Step S11), the charging bias Vdc(C)+20V is calculated by adding the bias correction value of 20 V to the charging bias Vdc(C) calculated in the first bias correction calculation as the charging bias to be applied to the charging roller 41 (Step S14). In this way, the charging bias values (Vdc(C) in Step S12, Vdc(C)+10V in Step S13 and Vdc(C)+20V) as the result of the second bias correction calculation can be obtained.

The values of the cumulative print number in Steps S9 to S11 are not exclusive to 500 and 1000 and step numbers of case-classification is not exclusive to three of Steps S9 to S11. For example, the cumulative print number may be equal to or larger than 0 and below 300, equal to or larger than 300 and below 700, equal to or larger than 700 and below 1500 and equal to or larger than 1500.

The number information obtaining operation in Step S8 may be performed between Steps S1 and S2. As described above, the cumulative operating time may be used instead of the cumulative print number. In this case, each of conditions in Step S9 and S10 are, for example, 0≦cumulative operating time<10 min, 10 min≦cumulative operating time<20 min and 20 min≦cumulative operating time, or the like. Similarly, the photoconductor temperature may be used instead of the cumulative print number. In these cases, the information obtained in Step S8 is the information of the cumulative operating time or photoconductor temperature.

In this way, a final charging bias value is determined by performing the bias correction through the first bias correction calculation to approach such a charging bias as to obtain the target current Idc(T) and by performing the bias correction through the second bias correction calculation also in consideration of the influence of the photoconductor temperature (temperature characteristic of the photoconductive drum 3). Thus, a proper charging bias can be outputted without extending the aging time until the start of an image forming operation even if the resistance value of the charging roller varies (or even if the resistance value drastically increases to increase a current detection error) and a proper charging bias can be outputted even if the I-V characteristic of the photoconductor varies.

Thereafter, an image forming operation (printing operation) is performed for the print job in Step S1 (Step S15). For example, if this print job is to print 100 copies and the determined charging bias is Vdc(C)+10V, the charging bias Vdc (C)+10V is applied to the charging roller 41 every time from the first to the $100^{th}$ copies and prints (image formations) are successively made. At this time, the number counting section 105 counts (sum up) an actually printed number. If the cumulative print number is not reset as described later at this time, the print number is added to the previous value.

In the image forming process of Step S15, if the print number exceeds 500 during the print job although the condition (equal to or larger than 0 and below 500) of the cumulative print number in Step S9 is initially satisfied and continuous printing is started with the charging bias Vdc(c) of Step S12, the charging bias may be switched from the presently set value of Vdc(c) to Vdc(C)+10V (charging bias value in Step S13) when the cumulative print number exceeds 500 (during this print job). Alternatively, the bias value may not be changed and printing may be performed with Vdc(c) until the present print job is finished (the bias value is changed upon carrying out a new print job). At any rate, it is sufficient to correct the charging bias Vdc according to the print number, i.e. the photoconductor temperature and arbitrary method and timing may be employed for such a correction.

Figure 8:
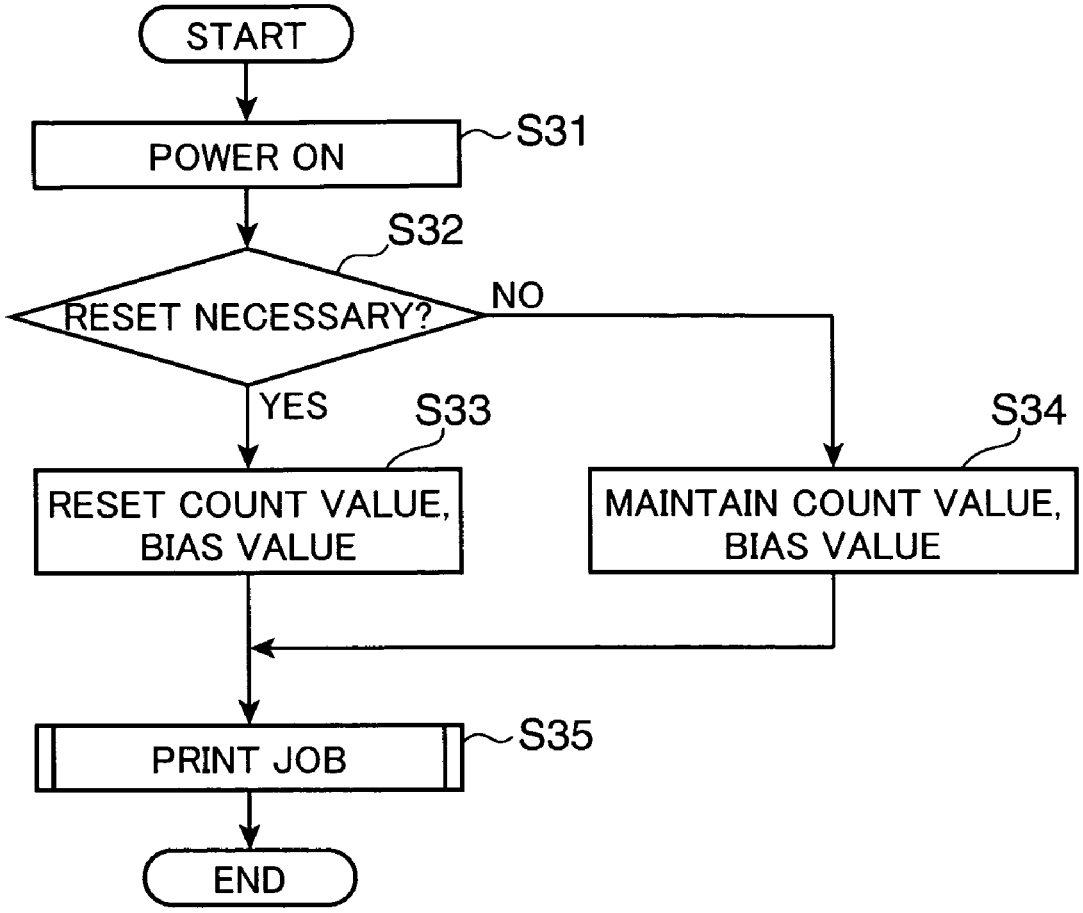
FIG. 8 is a flow chart showing an exemplary operation of resetting the charging bias.

FIG. 8 is a flow chart of an exemplary operation of resetting the charging bias. When the printer 1 is turned on (Step S31), the reset judging section 108 judges whether or not to satisfy such a condition that the temperature inside the printer 1 (e.g. temperature near the photoconductive drum 3)−temperature outside the printer 1≦specified temperature (e.g. 3° C.) based on the temperature measurement information by the temperature measuring section 107 (Step S32). If it is judged to satisfy this condition (YES in Step S32), the number counting section 105 resets the information of the cumulative print number to the initial value and the correction calculating section 103 resets the corrected charging bias to the initially set value (Step S33). If it is judged not to satisfy this condition (NO in Step S32), the present cumulative print number and corrected charging bias value in the number counting section 105 and the correction calculating section 103 are maintained as they are. Thereafter, a specified print job is carried out (Step S35). In Step S35, the flow of FIG. 7 is carried out.

In the Step S32, the reset judging section 108 may judge whether or not to satisfy such a condition that the elapsed time from the end of the printing operation in the last print job≧specified time based on time measurement information by the time measuring section 106. In the Step S33, the time measuring section 106 may reset the information of the cumulative operating time to the initial value (time count is started after this resetting) and the correction calculating section 103 may reset the corrected charging bias to the initially set value.

In the case of counting the cumulative operating time as the photoconductor information, the counting of the cumulative operating time (driving time) is started when power is turned on in the Step S31. In the case of counting this cumulative operating time, in the Step S34 where no resetting is necessary, the cumulativeness proceeds (e.g. time counting starts from the cumulative operating time when power was turned off last time) other than being kept at the same value unlike in the case of counting the cumulative print number.

Figure 9:
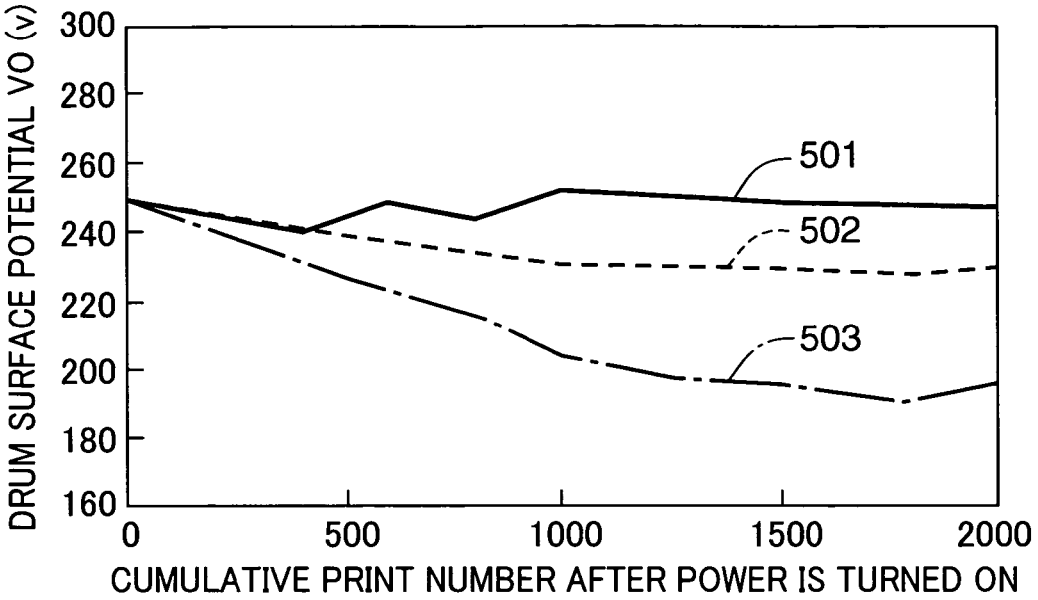
FIG. 9 is a graph showing an exemplary surface potential transition of the photoconductive drum in the case of performing a charging bias correction and in the case of performing no charging bias correction.

FIG. 9 shows an exemplary surface potential transition of the photoconductive drum in the case of performing the charging bias correction of this embodiment and in the case of performing no charging bias correction. A vertical axis represents surface potential V0 (V) and a horizontal axis represents cumulative print number after power is turned on. The drum unit (photoconductive drum) used had already a running state of 200 k (200000) when power was turned on. A surface potential variation characteristic 501 shown in FIG. 9 indicates a surface potential variation in the case of performing the charging bias correction by the first bias correction calculation through the repeat calculations using the above equation (1) of this embodiment and by the second bias correction calculation considering the photoconductor temperature, and a surface potential variation characteristic 502 indicates a surface potential variation in the case of performing the charging bias correction only by the first bias correction calculation. Further, a surface potential variation characteristic 503 indicates a surface potential variation in the case of performing no charging bias correction. According to this, it can be understood that the potential of the drum surface largely decreases in the surface potential variation characteristic 503 as the cumulative print number increases, but the surface potential is kept substantially constant in the surface potential variation characteristic 501. The surface potential is similarly kept substantially constant in the case of the surface potential variation characteristic 502 as well.

Figure 10:
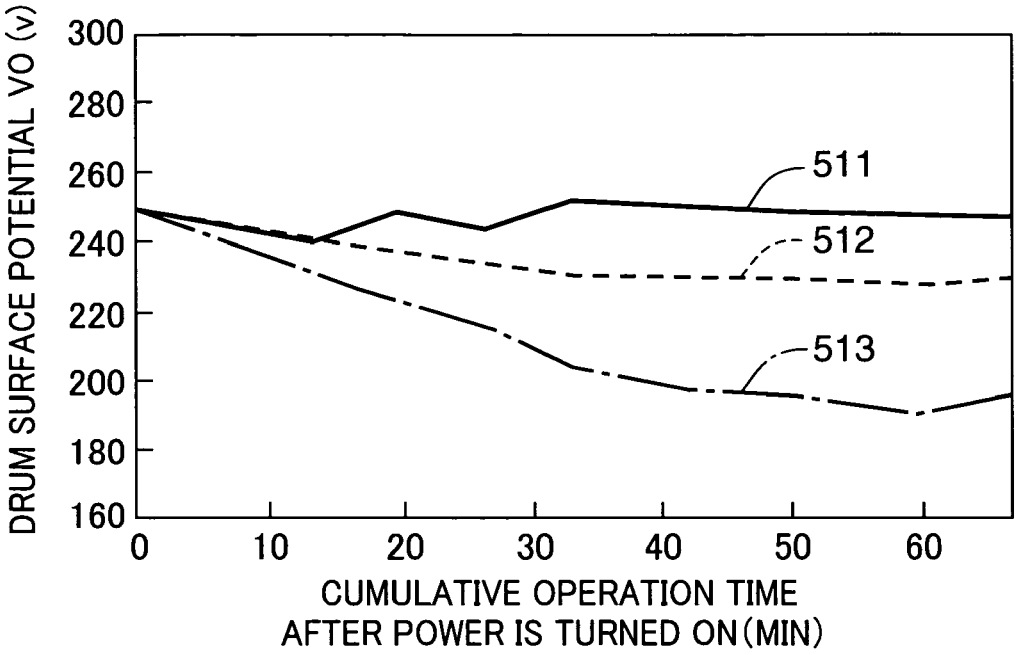
FIG. 10 is a graph showing another exemplary surface potential transition of the photoconductive drum in the case of performing a charging bias correction and in the case of performing no charging bias correction.

Similar to FIG. 9, FIG. 10 shows an exemplary surface potential transition of the photoconductive drum in the case of performing the charging bias correction of this embodiment and in the case of performing no charging bias correction. Here, a horizontal axis represents cumulative operating time (min) after power was turned on. The drum unit used already elapsed time corresponding to a running state of 200 k (200000) when power was turned on. As shown in FIG. 10, the potential of the drum surface largely decreases in a surface potential variation characteristic 513 as the cumulative operating time increases, but the surface potential is kept substantially constant in a surface potential variation characteristic 511. The surface potential is similarly kept substantially constant in the case of a surface potential variation characteristic 512 as well.

As described above, an image forming apparatus (printer 1) according to the present invention, there is provided with: the charging bias applying section 101 (bias applying device) for applying the charging bias (Vdc) to the charging roller 41; the charging current detecting section 102 (current detector) for detecting the charging current (Idc) when the charging bias is applied; the comparison information storage 104 (storage) for storing the target charging current value (target current Idc(T)) that is a charging current value when the surface of the photoconductor (photoconductive drum 3) is charged to the necessary surface potential; the correction calculating section 103 (bias corrector) for correcting the charging bias: and the photoconductor information detector for detecting the photoconductor information concerning the photoconductor temperature, the correction calculating section 103 conducts first bias correction calculation by performing the first calculation in which the first charging current value (Idc(A)) detected by the charging current detecting section 102 when the first charging bias (Vdc(A)) as the initially set value was applied by the charging bias applying section 101 is compared with the target charging current value stored in the comparison information storage 104, and by performing, repeatedly a specified number of times, a second calculation in which the second charging bias (Vdc(B)) based on the comparison result are calculated and the second charging current value (Idc(B)) detected by the charging current detecting section 102 when the second charging bias is applied by the charging bias applying section 101 is compared with the target charging current value in order to calculate the third charging bias based on the comparison result (first bias correction calculation is comprised of the first calculation and the second calculations repeated a specified number of times), and conducts the second bias correction calculation to correct the charging bias (e.g. Vdc(C) in Step 7 shown in FIG. 7) obtained as a result of the above first bias correction calculation (e.g. correction is made to set Vdc(C)+10V, Vdc(C)+20V in Step S13 or S14) shown in FIG. 7 based on the photoconductor information (cumulative print number, cumulative operating time or the temperature of the photoconductor) detected by the photoconductor information detector (number counting section 105, time measuring section 106 or temperature measuring section 107).

As described above, the first bias correction calculation is conducted in such a way that the charging current value Idc when a certain charging bias Vdc is applied is compared with the target charging current value Idc(T) and the calculation of correcting this charging bias Vdc based on the comparison result is repeatedly (at this time, however, the total number of repeat calculations is determined, e.g. to two beforehand) executed, and the second bias correction calculation is conducted to correct the charging bias obtained as a result of the first bias correction calculation based on the photoconductor information concerning the photoconductor temperature, so that a proper charging bias can be outputted without extending a time until the start of the image forming operation even if the resistance value of the charging roller 41 varies and a proper charging bias can be outputted even if the I-V characteristic of the photoconductor of the photoconductive drum 3 varies.

Further, since the repeat calculation in the first bias correction calculation is performed twice by the correction calculating section 103, i.e., since the total number of calculations in the first bias correction calculation, or the total calculation number including the first and second calculations is two (the first calculation is first performed and then the second calculation is performed to reach the total of two calculations), it is possible to quickly transfer to the second bias correction calculation while ensuring the minimum necessary number of repeat calculations to obtain the required charging bias correction accuracy in the first bias correction calculation, i.e. to further shorten the time until the start of the image forming operation.

Further, since the $(n+1)^{th}$ charging bias is calculated by the correction calculating section 103 which adds the $n^{th}$ bias correction value calculated using the above equation (1) to the $n^{th}$ charging bias in the respective repeat calculations in the first bias correction calculation, the first bias correction calculation can be efficiently performed using a simple arithmetic expression.

Further, since the cumulative print number after power was turned on or the cumulative operating time of the apparatus after power is turned on is used as the photoconductor information by the photoconductor information detector (number counting section 105 or time measuring section 106), that is, since the cumulative print number after the printer 1 was turned on or the cumulative operating time of the apparatus after power was turned on is detected as the photoconductor information, the photoconductor information can be easily obtained based on a simple construction of counting the print number or the operating time and consequently the second bias correction calculation can be efficiently performed.

Further, since the temperature of the photoconductor (photoconductive drum 3) is detected as the photoconductor information, i.e. the temperature obtained by measuring near (in the vicinity of) the photoconductor or the temperature obtained by directly measuring the photoconductor is used as the photoconductor information by the photoconductor information detector (temperature measuring section 107), the second bias correction calculation can be performed with high accuracy based on the temperature of the photoconductor itself.

In addition, the reset judging section 108 (judger) judges whether or not to satisfy the condition that apparatus internal temperature-apparatus external temperature≦specified temperature when power is on, or the condition that elapsed time after the end of the printing operation in the last print job≧specified time when power is on. If it is judged to satisfy the condition, the photoconductor information is reset to the specified initial information (initial value) by the photoconductor information detector (number counting section 105 or time measuring section 106), and the charging bias corrected by the first and second bias correction calculations is reset to the specified initial value by the correction calculating section 103. In this way, the charging bias can be prevented from being reset despite no drop in the temperature of the photoconductor when power is turned off and on within a very short period of time, for example, due to a certain machine trouble (including an error operation by the user), which consequently enables the charging bias to be reliably corrected.

Various constructions can be added or modified without departing from the gist of the present invention. For example, the printer 1 is not limited to the construction for monochromatic printing as shown in FIG. 1 and may have a construction for color printing (color printer).

As described above, an image forming apparatus of the present invention is for charging a surface of a photoconductor to a specified potential using a charging roller and comprises: a bias applying device for applying a charging bias to the charging roller; a current detector for detecting a charging current when the charging bias is applied; a storage for storing a target charging current value which is a charging current value when the surface of the photoconductor is charged to a necessary surface potential; a bias corrector for correcting the charging bias; and a photoconductor information detector for detecting photoconductor information concerning the temperature of the photoconductor, wherein the bias corrector conducts: a first bias correction calculation by performing a first calculation in which a first charging current value detected by the current detector when the first charging bias as an initially set value was applied by the bias applying device is compared with the target charging current value stored in the storage, and by performing, repeatedly a specified number of times, a second calculation in which a second charging bias based on the comparison result are calculated and then a second charging current value detected by the current detector when the second charging bias was applied by the bias applying device is compared with the target charging current value in order to calculate a third charging bias based on the comparison result; and a second bias correction calculation to correct the charging bias obtained as a result of the first bias correction calculation based on the photoconductor information detected by the photoconductor information detector.

According to the above construction, the bias corrector performs the first bias correction calculation by performing the first calculation in which the first charging current value detected by the current detector when the first charging bias as the initially set value was applied by the bias applying device is compared with the target charging current value stored in the storage, and by performing, repeatedly a specified number of times, a second calculation in which the second charging bias based on the comparison result are calculated and then the second charging current value detected by the current detector when the second charging bias was applied by the bias applying device is compared with the target charging current value in order to calculate the third charging bias based on the comparison result, and conducts the second bias correction calculation to correct the charging bias obtained as a result of the first bias correction calculation based on the photoconductor information detected by the photoconductor information detector.

In this way, the first bias correction calculation is conducted in such a way that the charging current value when a certain charging bias is applied is compared with the target charging current value and the calculation of correcting this charging bias based on the comparison result is repeatedly (at this time, however, the total number of repeat calculations is determined, e.g. to two beforehand) executed, and the second bias correction calculation is conducted to correct the charging bias obtained as a result of the first bias correction calculation based on the photoconductor information concerning the photoconductor temperature, so that a proper charging bias can be outputted without extending a time until the start of an image forming operation even if the resistance value of the charging roller varies and a proper charging bias can be outputted even if an I-V characteristic of the photoconductor varies.

In the above construction, the bias corrector preferably sets the total number of calculations in the first bias correction calculation to two.

According to this, the total number of calculations in the first bias correction calculation, i.e. the total number of calculations including the first and second calculations is set to two by the bias corrector. Specifically, in this case, the first calculation (one calculation) is first performed and then one second calculation (second calculation is repeated once) is performed. Therefore, a total of two calculations, i.e. up to the second one are performed.

Since the total number of calculations in the first bias correction calculation is set to two in this way, it is possible to quickly transfer to the second bias correction calculation while ensuring a minimum necessary number of repeat calculations (twice) to obtain the required charging bias correction accuracy in the first bias correction calculation, i.e. to further shorten the time until the start of the image forming operation.

In the above construction, the bias corrector calculates an $(n+1)^{th}$ charging bias by adding an $n^{th}$ bias correction value calculated using the above equation (1) to an $n^{th}$ charging bias in the first bias correction calculation if Idc(T) denotes the target charging current value:

$$(Idc(T)-Idc(n))*k \qquad \text{(the above equation (1))}$$

where Idc(n) denotes an $n^{th}$ charging current value, "k" a correction coefficient, "*" multiplication, and "n" an $n^{th}$ repeat count (n is a natural number).

According to this, the bias corrector calculates the $(n+1)^{th}$ charging bias by adding the $n^{th}$ bias correction value calculated using the above equation (1) to the $n^{th}$ charging bias in the first bias correction calculation.

Since the $n^{th}$ bias correction value calculated using the above equation (1) is added to the $n^{th}$ charging bias to calculate the $(n+1)^{th}$ charging bias in this way in the respective repeat calculation in the first bias correction calculation, the first bias correction calculation can be efficiently performed using a simple arithmetic expression.

In the above construction, the photoconductor information detector may detect a cumulative print number after power is turned on or a cumulative operating time of the apparatus after power is turned on as the photoconductor information.

According to this, the cumulative print number after power is turned on or the cumulative operating time of the apparatus after power is turned on is detected as the photoconductor information by the photoconductor information detector.

Since the cumulative print number after power is turned on or the cumulative operating time of the apparatus after power is turned on is detected as the photoconductor information by the photoconductor information detector in this way, the photoconductor information can be easily obtained based on a simple construction of counting the print number or the operating time and consequently the second bias correction calculation can be efficiently performed.

In the above construction, the photoconductor information detector may detect the temperature of the photoconductor as the photoconductor information. According to this, the temperature of the photoconductor is detected as the photoconductor information by the photoconductor information detector.

Since the temperature of the photoconductor is used as the photoconductor information in this way, the second bias correction calculation can be performed with high accuracy based on the temperature of the photoconductor itself (temperature near the photoconductor or the temperature of the photoconductor).

In the above construction, a judger may be further provided to judge whether or not to satisfy a condition that apparatus internal temperature−apparatus external temperature≦specified temperature when power is on, or a condition that elapsed time after the end of a printing operation in a last print job≧specified time when power is on, and the photoconductor information detector may reset the photoconductor information to specified initial information and the bias corrector may reset the charging bias corrected by the first and second bias correction calculations to a specified initial value if it is judged to satisfy the condition.

According to this, the judger judges whether or not to satisfy the condition that apparatus internal temperature−apparatus external temperature≦specified temperature when power is on, or the condition that elapsed time after the end of the printing operation in the last print job≧specified time when power is on, and the photoconductor information detector resets the photoconductor information to the specified initial information, and the bias corrector resets the charging bias corrected by the first and second bias correction calculations to the specified initial value if it is judged to satisfy the condition.

In this way, the photoconductor information and the charging bias are reset according to the condition that apparatus internal temperature−apparatus external temperature≦specified temperature when power is on, or the condition that elapsed time after the end of the printing operation in the last print job≧specified time when power is on. Thus, the charging bias can be prevented from being reset despite no drop in the temperature of the photoconductor when power is turned off and on within a very short period of time, for example, due to a certain machine trouble (including an error operation by the user), which consequently enables the charging bias to be reliably corrected.

What is claimed is:

1. An image forming apparatus for charging a surface of a photoconductor to a specified potential using a charging roller, comprising:

a bias applying device for applying a charging bias to the charging roller;

a current detector for detecting a charging current when the charging bias is applied;

a storage for storing a target charging current value which is a charging current value when the surface of the photoconductor is charged to a necessary surface potential;

a bias corrector for correcting the charging bias; and a photoconductor information detector for detecting photoconductor information concerning the temperature of the photoconductor, wherein the bias corrector:

conducts a first comparison in which a first charging current value detected by the current detector when the first charging bias as an initially set value was applied by the bias applying device is compared with the target charging current value stored in the storage and then conducts a first bias correction calculation in which a second charging bias is calculated based on the first comparison result, and repeatedly performs a second calculation a specified number of times to calculate a second charging bias based on the first comparison result and then conducts a second comparison in which a second charging current value detected by the current detector when the second charging bias was applied by the bias applying device is compared with the target charging current value in order to calculate a third charging bias based on the second comparison result; and conducts a second bias correction calculation to correct the third charging bias obtained as a result of the first bias correction calculation based on the photoconductor information detected by the photoconductor information detector.

2. An image forming apparatus according to claim 1, wherein the bias corrector sets the total number of calculations in the first bias correction calculation to two.

3. An image forming apparatus according to claim 2, wherein the bias corrector calculates an $(n+1)^{th}$ charging bias by adding an $n^{th}$ bias correction value calculated using an equation (1) below to an $n^{th}$ charging bias in the first bias correction calculation if Idc(T) denotes the target charging current value:

$$(Idc(T)-Idc(n))*k \qquad \text{(the above equation (1))}$$

where Idc(n) denotes an $n^{th}$ charging current value, "k" a correction coefficient, "*" multiplication, and "n" an $n^{th}$ repeat count (n is a natural number).

4. An image forming apparatus according to claim 1, wherein the photoconductor information detector detects a cumulative print number after power is turned on, or a cumulative operating time of the apparatus after power is turned on as the photoconductor information.

5. An image forming apparatus according to claim 1, wherein the photoconductor information detector detects the temperature of the photoconductor as the photoconductor information.

6. An image forming apparatus for charging a surface of a photoconductor to a specified potential using a charging roller, comprising:

a bias applying device for applying a charging bias to the charging roller;

a current detector for detecting a charging current when the charging bias is applied;

a storage for storing a target charging current value which is a charging current value when the surface of the photoconductor is charged to a necessary surface potential;

a bias corrector for correcting the charging bias;

a photoconductor information detector for detecting photoconductor information concerning the temperature of the photoconductor; and a judger for judging whether or not to satisfy a condition that apparatus internal temperature−apparatus external temperature≦specified temperature when power is on or a condition that elapsed time after the end of a printing operation in a last print job specified time when power is on, wherein the bias corrector:

conducts a first comparison in which a first charging current value detected by the current detector when the first charging bias as an initially set value was applied by the bias applying device is compared with the target charging current value stored in the storage and then conducts a first bias correction calculation in which a second charging bias is calculated based on the first comparison result, and repeatedly performs a second calculation a specified number of times to calculate a second charging bias based on the first comparison result and then performs a second comparison in which a second charging current value detected by the current detector when the second charging bias was applied by the bias applying device is compared with the target charging current value to calculate a third charging bias based on the comparison result; and conducts a second bias correction calculation to correct the third charging bias obtained as a result of the first bias correction calculation based on the photoconductor information detected by the photoconductor information detector, and wherein the photoconductor information detector resets the photoconductor information to specified initial information and the bias corrector resets the charging bias corrected by the first and second bias correction calculations to a specified initial value if it is judged to satisfy the condition.

7. An image forming apparatus for charging a surface of a photoconductor to a specified potential using a charging roller, comprising:

a bias applying device for applying a charging bias to the charging roller;

a current detector for detecting a charging current when the charging bias is applied;

a storage for storing a target charging current value which is a charging current value when the surface of the photoconductor is charged to a necessary surface potential;

a bias corrector for correcting the charging bias; and a photoconductor information detector for detecting photoconductor information concerning the temperature of the photoconductor, wherein the bias corrector:

conducts a first comparison in which a first charging current value detected by the current detector when the first charging bias as an initially set value was applied by the bias applying device is compared with the target charging current value stored in the storage and then conducts a first bias correction calculation in which a second charging bias is calculated based on the first comparison result, and repeatedly performs a second calculation a specified number of times to calculate a second charging bias based on the first comparison result and then conducts a second comparison in which a second charging current value detected by the current detector when the second charging bias was applied by the bias applying device is compared with the target charging current value and then calculates a third charging bias based on the second comparison result; and conducts a second bias correction calculation to correct the third charging bias obtained as a result of the first bias correction calculation based on the photoconductor information detected by the photoconductor information detector, and wherein:

the bias corrector calculates an $(n+1)^{th}$ charging bias by adding an $n^{th}$ bias correction value calculated using an equation (1) below to an $n^{th}$ charging bias in the first bias correction calculation if Idc(T) denotes the target charging current value:

$$(Idc(T)-Idc(n))*k \qquad \text{(the above equation (1))}$$

where Idc(n) denotes an $n^{th}$ charging current value, "k" a correction coefficient, "*" multiplication, and "n" an $n^{th}$ repeat count (n is a natural number).

8. An image forming apparatus according to claim 7, wherein the photoconductor information detector detects a cumulative print number after power is turned on, or a cumulative operating time of the apparatus after power is turned on as the photoconductor information.

9. An image forming apparatus according to claim 7, wherein the photoconductor information detector detects the temperature of the photoconductor as the photoconductor information.

* * * * *